US010006655B2

(12) United States Patent
Moriyama

(10) Patent No.: US 10,006,655 B2
(45) Date of Patent: Jun. 26, 2018

(54) OUTDOOR UNIT FOR AIR-CONDITIONING APPARATUS

(71) Applicant: Mitsubishi Electric Corporation, Tokyo (JP)

(72) Inventor: Takefumi Moriyama, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 22 days.

(21) Appl. No.: 14/874,719

(22) Filed: Oct. 5, 2015

(65) Prior Publication Data

US 2016/0138825 A1 May 19, 2016

(30) Foreign Application Priority Data

Nov. 13, 2014 (JP) ..... 2014-230727

(51) Int. Cl.

| | |
|---|---|
| ***F24H 3/02*** | (2006.01) |
| ***F24F 13/22*** | (2006.01) |
| ***F28F 17/00*** | (2006.01) |
| ***F28F 19/00*** | (2006.01) |
| ***F24F 13/20*** | (2006.01) |
| *F24F 1/06* | (2011.01) |
| *F24F 1/36* | (2011.01) |
| *F24F 1/46* | (2011.01) |

(52) U.S. Cl.

CPC ..... *F24F 13/222* (2013.01); *F24F 13/20* (2013.01); *F28F 17/00* (2013.01); *F28F 17/005* (2013.01); *F28F 19/006* (2013.01); *F24F 1/06* (2013.01); *F24F 1/36* (2013.01); *F24F 1/46* (2013.01); *F24F 2221/34* (2013.01)

(58) Field of Classification Search

CPC ..... F28F 17/00; F28F 17/005; F28F 19/006; F24F 13/22; F24F 13/222; F24F 2013/227; F24F 2221/34; F25D 21/08; F25D 21/14

USPC ..... 165/134.1

See application file for complete search history.

(56) References Cited

U.S. PATENT DOCUMENTS

| | | | | |
|---|---|---|---|---|
| 2013/0205823 A1* | 8/2013 | Yagyu | F24F 1/18 | 62/324.5 |
| 2014/0165640 A1* | 6/2014 | Takeuchi | F25D 21/14 | 62/275 |

FOREIGN PATENT DOCUMENTS

| | | | | |
|---|---|---|---|---|
| EP | 2 743 599 A2 | | 6/2014 | |
| JP | 2004-069220 A | | 3/2004 | |
| JP | 2010-071514 A | | 4/2010 | |
| JP | 2010-091140 A | | 4/2010 | |
| JP | 2011052941 A | * | 3/2011 | F24F 1/06 |

(Continued)

OTHER PUBLICATIONS

JP 2011-052941, Naito, Mar. 17, 2011, machine translation.*

(Continued)

*Primary Examiner* — Hung Q Nguyen
*Assistant Examiner* — Mark L Greene
(74) *Attorney, Agent, or Firm* — Posz Law Group, PLC

(57) ABSTRACT

An outdoor unit for an air-conditioning apparatus includes a casing including a bottom panel having an opening, an outdoor fan provided in the casing, a heater provided on the bottom panel, a heater guard provided to face the heater, and a shield portion thermally connected to the heater guard. The shield portion is positioned on a downstream side with respect to the opening in a direction of airflow and on an upstream side with respect to an end in the upstream side of the heater guard in the direction of airflow.

4 Claims, 3 Drawing Sheets

(56) References Cited

FOREIGN PATENT DOCUMENTS

| | | | |
|---|---|---|---|
| JP | 2012-107820 | A | 6/2012 |
| JP | 2014-066489 | A | 4/2014 |

OTHER PUBLICATIONS

Extended European Search Report dated May 2, 2016 issued in corresponding EP patent application No. 15189981.2.
Office Action dated Mar. 14, 2017 issued in corresponding JP patent application No. 2014-230727 (and English translation).
Communication pursuant to Article 94(3) EPC dated Dec. 6, 2017 issued in corresponding EP patent application No. 15 189 981.2.
Office Action dated Jan. 2, 2018 issued in corresponding CN patent application No. 201510727875.6 (and English translation).

* cited by examiner

OUTDOOR UNIT FOR AIR-CONDITIONING APPARATUS

TECHNICAL FIELD

The present invention relates to an outdoor unit for an air-conditioning apparatus.

BACKGROUND ART

One of known outdoor units for air-conditioning apparatuses includes a drain pan having a drain hole, a heater provided on the drain pan, and a protection plate including a wall portion that covers a part of the heater (see Patent Literature 1). In the outdoor unit for an air-conditioning apparatus disclosed by Patent Literature 1, the wall portion prevents the heater from touching the hands of the worker.

Another known outdoor unit for an air-conditioning apparatus includes a bottom plate having a drain port, a lower fixing member fitted in the drain port, an upper fixing member provided above the lower fixing member, and an antifreezing heater held between the upper fixing member and the lower fixing member (see Patent Literature 2, for example). In the outdoor unit for an air-conditioning apparatus disclosed by Patent Literature 2, the upper fixing member and the lower fixing member hold the antifreezing heater therebetween, thereby preventing the antifreezing heater from touching the hands of the worker.

Yet another outdoor unit for an air-conditioning apparatus includes an outdoor-unit base having a drain hole, a heater provided on the outdoor-unit base, and an isolating plate provided over the heater (see Patent Literature 3, for example). In the outdoor unit for an air-conditioning apparatus disclosed by Patent Literature 3, the isolating plate prevents the heater from touching the hands of the worker.

CITATION LIST

Patent Literature

[Patent Literature 1] Japanese Unexamined Patent Application Publication No. 2010-91140 ([0049] and FIG. 7)

[Patent Literature 2] Japanese Unexamined Patent Application Publication No. 2010-71514 ([0012] to [0019] and FIG. 8)

[Patent Literature 3] Japanese Unexamined Patent Application Publication No. 2004-69220 ([0017] and FIG. 1)

SUMMARY OF INVENTION

Technical Problem

In the outdoor unit for an air-conditioning apparatus disclosed by Patent Literature 1, the wall portion faces the heater and therefore has a high temperature. Hence, maintenance work needs to be performed carefully so that the hands of the worker do not touch the wall portion. Consequently, the work efficiency is reduced. The outdoor unit for an air-conditioning apparatus disclosed by Patent Literature 1 has another problem in that cool air flowing from the outside of the outdoor unit into the outdoor unit through the drain hole may blow against any members other than the wall portion and freeze such members.

In the outdoor unit for an air-conditioning apparatus disclosed by Patent Literature 2, the fixing members face the heater and therefore each have a high temperature. Hence, maintenance work needs to be performed carefully so that the hands of the worker do not touch the fixing members. Consequently, the work efficiency is reduced. The outdoor unit for an air-conditioning apparatus disclosed by Patent Literature 2 has another problem in that cool air flowing from the outside of the outdoor unit into the outdoor unit through the drain port may blow against any members other than the fixing members and freeze such members.

In the outdoor unit for an air-conditioning apparatus disclosed by Patent Literature 3, the isolating plate faces the heater and therefore has a high temperature. Hence, maintenance work needs to be performed carefully so that the hands of the worker do not touch the isolating plate. Consequently, the work efficiency is reduced. The outdoor unit for an air-conditioning apparatus disclosed by Patent Literature 3 has another problem in that cool air flowing from the outside of the outdoor unit into the outdoor unit through the drain hole may blow against any members other than the isolating plate and freeze such members.

In view of the above problems, the present invention provides an outdoor unit for an air-conditioning apparatus that exhibits higher work efficiency than that provided in the known art and in which members provided in a casing thereof are prevented from being frozen.

Solution to Problem

An outdoor unit for an air-conditioning apparatus according to the present invention includes a casing including a bottom panel having an opening, an outdoor fan provided in the casing, a heater provided on the bottom panel, a heater guard provided to face the heater, and a shield portion thermally connected to the heater guard. The shield portion is positioned on a downstream side with respect to the opening in a direction of airflow and on an upstream side with respect to an end in the upstream side of the heater guard in the direction of airflow.

Advantageous Effects of Invention

In the outdoor unit for an air-conditioning apparatus according to the present invention, the shield portion is positioned on the downstream side with respect to the opening in the direction of air flow and on the upstream side with respect to the heater guard in the direction of airflow. Thus, the present invention can provide an outdoor unit for an air-conditioning apparatus that exhibits high work efficiency and in which members provided in a casing thereof are prevented from being frozen.

DESCRIPTION OF EMBODIMENTS

Figure 1:
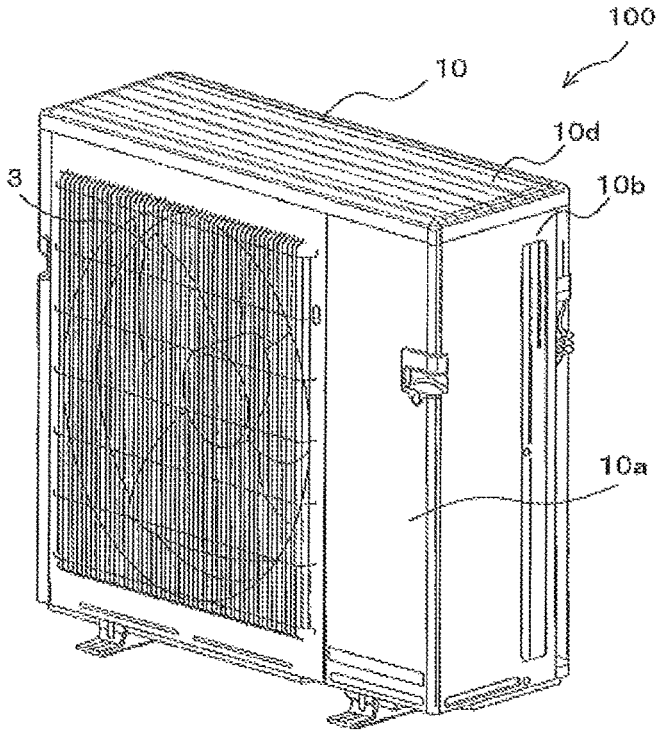
FIG. 1 is a perspective view of an outdoor unit 100 for an air-conditioning apparatus according to Embodiment of the present invention.

An embodiment of the present invention will now be described with reference to the accompanying drawings. Note that elements illustrated in the drawings including FIG. 1 are not necessarily scaled in accordance with their actual sizes. Furthermore, in the drawings including FIG. 1, like reference numerals denote like or corresponding elements, which applies throughout this specification. Furthermore, embodiments of the individual elements described herein are only exemplary and are not limited thereto.

FIG. 1 is a perspective view of an outdoor unit 100 for an air-conditioning apparatus according to Embodiment. As illustrated in FIG. 1, the outdoor unit 100 has a casing 10 as an outer shell. The casing 10 includes a front-and-side panel 10*a*, a right side panel 10*b*, a bottom panel 10*c* (see FIG. 3), a top panel 10*d*, and a rear panel (not illustrated). The front-and-side panel 10*a* forms a front face and a left side face of the casing 10 and has, for example, an L-shape in plan view. The casing 10 houses an outdoor fan 3, an outdoor-fan motor (not illustrated), and so forth.

The outdoor fan 3 is an air-sending device including, for example, a propeller fan. The outdoor fan 3 takes outdoor air into the casing 10 from the rear side of the casing 10 and exhausts the taken outdoor air toward the front side of the casing 10. The outdoor-fan motor is a driving device that drives the outdoor fan 3.

Figure 2:
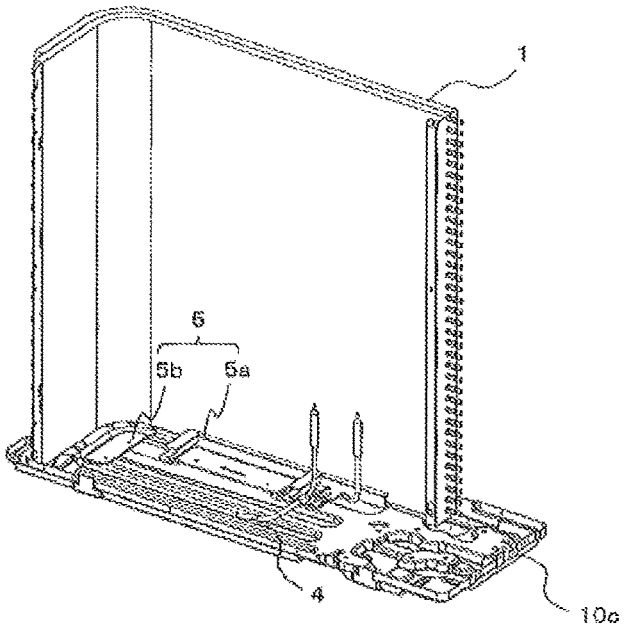
FIG. 2 is a perspective view of an outdoor heat exchanger 1 and a bottom panel 10*c* included in the outdoor unit 100 for an air-conditioning apparatus according to Embodiment of the present invention.
Figure 3:
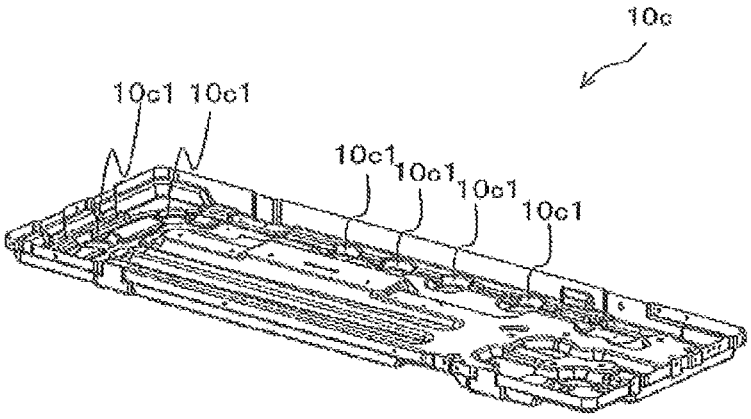
FIG. 3 is a perspective view of the bottom panel 10*c* of the outdoor unit 100 for an air-conditioning apparatus according to Embodiment of the present invention.
Figure 4:
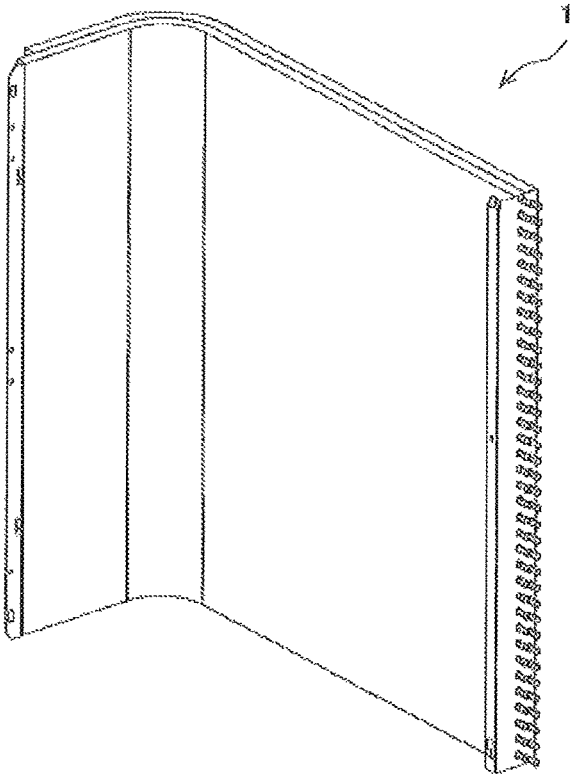
FIG. 4 is a perspective view of the outdoor heat exchanger 1 of the outdoor unit 100 for an air-conditioning apparatus according to Embodiment of the present invention.
Figure 5:
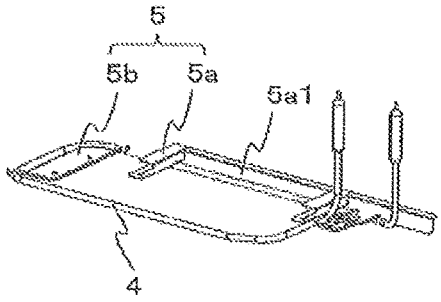
FIG. 5 is a perspective view of a heater 4 and a heater guard 5 included in the outdoor unit 100 for an air-conditioning apparatus according to Embodiment of the present invention.

FIG. 2 is a perspective view of an outdoor heat exchanger 1 and the bottom panel 10*c* included in the outdoor unit 100 for an air-conditioning apparatus according to Embodiment of the present invention. FIG. 3 is a perspective view of the bottom panel 10*c* of the outdoor unit 100 for an air-conditioning apparatus according to Embodiment of the present invention. FIG. 4 is a perspective view of the outdoor heat exchanger 1 of the outdoor unit 100 for an air-conditioning apparatus according to Embodiment of the present invention. FIG. 5 is a perspective view of a heater 4 and a heater guard 5 included in the outdoor unit 100 for an air-conditioning apparatus according to Embodiment of the present invention.

Referring to FIG. 2, the casing 10 houses, in addition to the outdoor fan 3 and the outdoor-fan motor, the outdoor heat exchanger 1, the heater 4, and the heater guard 5. The outdoor heat exchanger 1 and the heater 4 are provided on the upper surface of the bottom panel 10*c*. The heater guard 5 includes heater guards 5*a* and 5*b*.

Referring to FIG. 3, the bottom panel 10*c* has a plurality of openings 10*c*1 (the number of openings 10*c*1 may be at least one). The openings 10*c*1 are provided for discharging drain water generated in the casing 10. The openings 10*c*1 each extend through the bottom panel 10*c* from the upper surface to the lower surface. More specifically, for example, some of the openings 10*c*1 are aligned in the lateral direction of the casing 10 on a side of the bottom panel 10*c* that is near the rear face of the casing 10, while the other openings 10*c*1 are aligned in the anteroposterior direction of the casing 10 on a side of the bottom panel 10*c* that is near the left side face of the casing 10. The openings 10*c*1 are provided on the rear side of the casing 10, that is, on the upstream side in the direction of airflow, with respect to the outdoor fan 3.

Referring to FIG. 4, the outdoor heat exchanger 1 has, for example, an L shape in plan view and extends along the left side face of the front-and-side panel 10*a* and the rear panel (not illustrated). The outdoor heat exchanger 1 is provided on the rear side of the outdoor unit 100 with respect to the outdoor fan 3 and the outdoor-fan motor, and on the outer side of the bottom panel 10*c* with respect to the openings 10*c*1 provided in the bottom panel 10*c*. The outdoor heat exchanger 1 functions as an evaporator in a heating operation and as a condenser in a cooling operation.

Referring to FIG. 5, the heater 4 has, for example, a plurality of bent parts. More specifically, the heater 4 is bent in such a manner as to conform to the plan-view shape of the outdoor heat exchanger 1 and to be positioned farther from the outer periphery of the bottom panel 10*c* than the openings 10*c*1 provided in the bottom panel 10*c*. The heater guard 5*a* prevents the heater 4 from moving and includes a first portion 5*a*1 and a second portion 5*a*2 (see FIG. 6). The first portion 5*a*1 is provided above a portion of the heater 4 that extends on the rear side of the casing 10 and in the lateral direction of the casing 10. Details of the second portion 5*a*2 will be described later. The heater guard 5*b* is provided above another portion of the heater 4 that extends on the left side of the casing 10 and in the anteroposterior direction of the casing 10. The heater 4 is connected to a lead wire (not illustrated) and is thus connected to a controller (not illustrated) via a connector (not illustrated).

The controller controls, for example, the temperature of the heater 4 in accordance with information such as the result of detection obtained by a temperature detector (not illustrated). The controller includes, for example, software that is executed on hardware, such as a circuit device, or an arithmetic device, such as a microcomputer or a central processing unit (CPU), which realizes the above function.

Figure 6:
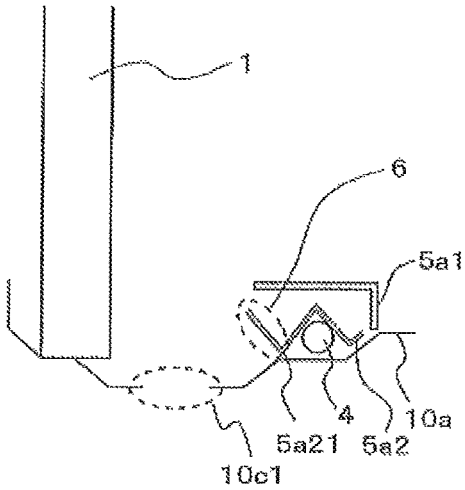
FIG. 6 is a schematic side view of an internal configuration of the outdoor unit 100 for an air-conditioning apparatus according to Embodiment of the present invention.
Figure 7:
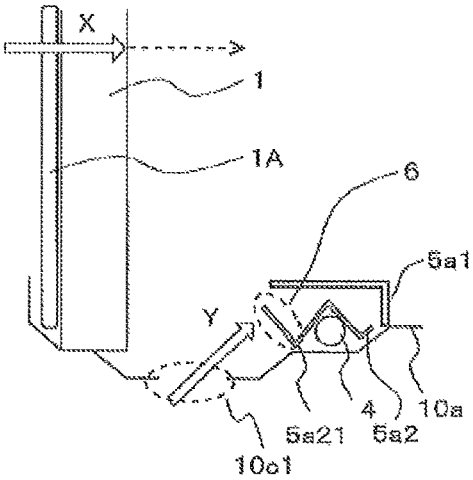
FIG. 7 is another schematic side view of the internal configuration of the outdoor unit 100 for an air-conditioning apparatus according to Embodiment of the present invention, and illustrates flows of air.

FIG. 6 is a schematic side view of an internal configuration of the outdoor unit 100 for an air-conditioning apparatus according to Embodiment of the present invention. FIG. 7 is another schematic side view of the internal configuration of the outdoor unit 100 for an air-conditioning apparatus according to Embodiment of the present invention, and illustrates flows of air. The left side in FIGS. 6 and 7 corresponds to the rear side of the casing 10, and the right side in FIGS. 6 and 7 corresponds to the front side of the casing 10.

Referring to FIG. 6, the second portion 5*a*2 is provided below the first portion 5*a*1. The second portion 5*a*2 is provided with a shield portion 6. The second portion 5*a*2 and the shield portion 6 are positioned on the front side of the casing 10 with respect to the openings 10*c*1. The second portion 5*a*2 and the shield portion 6 are, for example, integrated with each other. The second portion 5*a*2 has a shape that is convex upward in side view. The second portion 5*a*2 is thermally connected to the shield portion 6 at an extreme end 5*a*21 thereof that is on the rear side of the casing 10. The shield portion 6 projects from the end 5*a*21 upwardly, i.e. toward the upper side of the casing 10 while extending toward the upstream side in the direction of airflow, that is, toward the rear side of the casing 10. The shield portion 6 is positioned farther from the heater 4 than the second portion 5*a*2 and nearer to the openings 10*c*1 than the second portion 5*a*2. The shield portion 6 is provided at a position that does not face the heater 4. That is, the shield portion 6 is less susceptible to the heat from the heater 4 than the second portion 5*a*2 and therefore has a lower temperature than the second portion 5*a*2. The shield portion 6 is at an acute angle with respect to the plane of each of the openings 10c1 provided in the bottom panel 10c. The second portion 5a2 corresponds to the heater guard according to the present invention.

The second portion 5a2 and the shield portion 6 may be either integrated with each other or separated from each other, as long as the heat from the heater 4 is transmitted to the shield portion 6 via any member.

Now, airflows generated in the outdoor unit 100 for an air-conditioning apparatus according to Embodiment of the present invention will be described with reference to FIG. 7. The following description is based on an assumption that an air-conditioning apparatus including the outdoor unit 100 is installed in a cold place and is in heating operation. The outdoor fan 3 is provided on the front side of the casing 10 with respect to the outdoor heat exchanger 1 and the openings 10c1. Therefore, when the outdoor fan 3 is rotated, an airflow X and an airflow Y are generated.

The airflow X travels from the rear side of the casing 10 toward the front side of the casing 10. Outdoor air flowing into the casing 10 passes through the outdoor heat exchanger 1, where the air exchanges heat with refrigerant flowing in the outdoor heat exchanger 1. The temperature of the air thus flowed into the casing 10 drops after the heat exchange between the air and the refrigerant flowing in the outdoor heat exchanger 1. Then, the air is exhausted toward the front side of the casing 10.

The airflow Y travels from the lower rear side of the casing 10 toward the upper front side of the casing 10. There are provided the openings 10c1, the shield portion 6, and the second portion 5a2 in that order from the upstream side toward the downstream side in the direction of the airflow Y. Therefore, the outdoor air flowing from the outside of the casing 10 into the casing 10 through the openings 10c1 is highly expected to blow against the shield portion 6 before blowing against the second portion 5a2.

The outdoor heat exchanger 1 functions as an evaporator in the heating operation. Therefore, referring to FIG. 7, frost 1A may occur on the rear side of the casing 10 with respect to the outdoor heat exchanger 1. In such a case, the outdoor air flowing into the casing 10 touches the frost 1A, whereby the outdoor air releases its heat and the temperature thereof drops. That is, the temperature inside the casing 10 with some frost 1A occurring on the outdoor heat exchanger 1 is lower than the temperature inside the casing 10 with no frost 1A occurring on the outdoor heat exchanger 1. Therefore, if the airflow X is generated in such a situation, the probability of dew condensation inside the casing 10 increases. Furthermore, if the airflow Y is generated in such a situation, low-temperature outdoor air flowing into the casing 10 increases the probability of frosting inside the casing 10.

As described above, the shield portion 6 projects upwardly from the end 5a21 toward the upper side of the casing 10 while extending toward the rear side of the casing 10. Therefore, some of the air traveling in the direction of the airflow Y blows against the shield portion 6. That is, in the case where the shield portion 6 is provided, the air traveling in the direction of the airflow Y is less likely to blow against members provided in the casing 10 excluding the shield portion 6 than in a case where the shield portion 6 is not provided. Thus, the probability that the members provided in the casing 10 excluding the shield portion 6 may be frozen can be reduced.

Some of the air traveling in the direction of the airflow Y blows against the shield portion 6 and removes heat from the shield portion 6, whereby the shield portion 6 releases its heat and the temperature thereof drops. Meanwhile, the heat from the heater 4 is transmitted to the shield portion 6 via the second portion 5a2, whereby the temperature of the shield portion 6 rises. That is, even if the temperature of the shield portion 6 is lowered by the air flowing in the direction of the airflow Y, the shield portion 6 receives the heat from the heater 4 and the temperature of the shield portion 6 rises. Therefore, the probability that the shield portion 6 may be frozen is reduced. Furthermore, the heat from the second portion 5a2 and from the shield portion 6 is transmitted to members provided in the casing 10 excluding the second portion 5a2 and the shield portion 6. Hence, the probability that the members provided in the casing 10 excluding the second portion 5a2 and the shield portion 6 may be frozen is also reduced.

As described above, in the outdoor unit 100 for an air-conditioning apparatus according to Embodiment, the shield portion 6 is positioned on the downstream side with respect to the openings 10c1 in the direction of airflow and on the upstream side with respect to the end 5a21 of the second portion 5a2 that is the extreme end on the upstream side in the direction of airflow. Therefore, the temperature of the shield portion 6 is lower than the temperature of the second portion 5a2. Accordingly, the necessity of the worker being careful so as not to touch the shield portion 6 through the openings 10c1 is lower than in the known art. Hence, the work efficiency is higher than in the known art. Furthermore, some of the air flowing from the outside of the casing 10 into the casing 10 through the openings 10c1 blows against the shield portion 6. Therefore, the probability that members provided in the casing 10 excluding the shield portion 6 may be frozen is reduced.

While the above description concerns an exemplary case where the heater guard 5 covers only the portion of the heater 4 that extends in the lateral direction of the casing 10, the present invention is not limited to such a case. For example, the heater guard 5 may also cover the portion of the heater 4 that extends in the anteroposterior direction of the casing 10. Thus, the advantageous effects of Embodiment described above are enhanced.

The positional relationship between the shield portion 6 and the openings 10c1 is not limited to that illustrated in the associated drawings. However, it is desirable that the openings 10c1 and the shield portion 6 be positioned close to each other. In such an arrangement, air flowing into the casing 10 through the openings 10c1 is highly expected to blow against the shield portion 6. Thus, the advantageous effects of Embodiment described above are further enhanced.

REFERENCE SIGNS LIST

1: outdoor heat exchanger 1A: frost 3: outdoor fan 4: heater

5, 5a: heater guard 5a1: first portion 5a2: second portion

5a21: end 5b: heater guard 6: shield portion 10: casing 10a: front-and-side panel 10b: right side panel 10c: bottom panel

10c1: opening 10d: top panel 100: outdoor unit X, Y: airflow

The invention claimed is:

1. An outdoor unit for an air-conditioning apparatus, the outdoor unit comprising:

a casing including a front side, a rear side, and a bottom panel, the bottom panel having a bottom surface and an opening in the bottom surface;

an outdoor fan provided in the casing;

a heater provided on the bottom panel;

a heater guard provided to face the heater and positioned downstream from the opening in the bottom surface of the bottom panel in an airflow direction; and a shield portion thermally connected to an upstream end of the heater guard at a position downstream from the opening in the bottom surface of the bottom panel in the airflow direction, the shield portion projecting from the upstream end of the heater guard and extending upwardly toward the rear side of the casing;

wherein the shield portion is positioned entirely downstream from the opening in the airflow direction; and wherein the outdoor fan is provided in the front side of the casing and configured to create airflow in the airflow direction where the air is drawn into the casing through the opening in the bottom surface of the bottom panel and is expelled out the front side of the casing.

2. The outdoor unit for an air-conditioning apparatus of claim 1, wherein the shield portion is inclined toward the opening in the bottom surface of the bottom panel and is at an acute angle with respect to an ideal plane parallel to a plane of the opening.

3. An outdoor unit for an air-conditioning apparatus, the outdoor unit comprising:

a casing including a front side, a rear side, and a bottom panel, the bottom panel having an opening;

an outdoor fan provided in the casing;

a heater provided on the bottom panel;

a heater guard provided to face the heater and positioned downstream from the opening in the bottom panel in an airflow direction of air flowing through the opening; and a shield portion thermally connected to an upstream end of the heater guard at a position downstream from the opening in the bottom panel in the airflow direction, the shield portion projecting from the upstream end of the heater guard and extending upwardly toward the rear side of the casing;

wherein the shield portion is positioned entirely downstream from the opening in the airflow direction; and wherein the outdoor fan is provided in the front side of the casing and configured to create airflow in the airflow direction where the air is drawn into the casing through the opening in the bottom panel and is expelled out the front side of the casing.

4. The outdoor unit for an air-conditioning apparatus of claim 3, wherein the shield portion is inclined toward the opening and is at an acute angle with respect to an ideal plane parallel to a plane of the opening.

* * * * *